US006592182B1

(12) United States Patent
Noor

(10) Patent No.: US 6,592,182 B1
(45) Date of Patent: Jul. 15, 2003

(54) STACKABLE FOLDING CHAIR

(75) Inventor: Zunaidi Bin Noor, Selangor (MY)

(73) Assignee: Mah Sing Plastics Industries Sdn Bhd, Selangor (MY)

( * ) Notice: Subject to any disclaimer, the term of this patent is extended or adjusted under 35 U.S.C. 154(b) by 0 days.

(21) Appl. No.: 10/102,664

(22) Filed: Mar. 22, 2002

(30) Foreign Application Priority Data

Jan. 21, 2002 (MY) ..... PI 2002 0231

(51) Int. Cl.[7] ..... A47C 3/04; A47C 4/10
(52) U.S. Cl. ..... 297/239; 297/58; 297/440.22
(58) Field of Search ..... 297/239, 440.22, 297/58, 16; 108/91, 53.1

(56) References Cited

U.S. PATENT DOCUMENTS

| | | | | |
|---|---|---|---|---|
| 1,674,220 A | | 6/1928 | Percival | |
| 1,876,549 A | * | 9/1932 | Bales | 297/41 |
| 2,390,878 A | | 12/1945 | Greitzer | |
| 3,021,175 A | | 2/1962 | Norquist | |
| 3,042,447 A | | 7/1962 | Wilkinson | |
| 3,431,022 A | | 3/1969 | Poppe et al. | |
| 3,655,239 A | * | 4/1972 | Agosti | 297/331 |
| 3,695,687 A | | 10/1972 | Uyeda | |
| 3,825,302 A | | 7/1974 | Kurtz | |
| 4,298,227 A | | 11/1981 | Berthier et al. | |
| 4,619,207 A | | 10/1986 | Boyce et al. | |
| 4,682,816 A | | 7/1987 | Massonnet | |
| 5,064,247 A | | 11/1991 | Clark et al. | |
| 5,096,259 A | | 3/1992 | Stanfield | |
| 5,167,436 A | | 12/1992 | Wu | |
| 5,634,684 A | | 6/1997 | Kojima et al. | |
| 5,718,474 A | * | 2/1998 | Kojima et al. | 297/58 |
| 5,738,408 A | | 4/1998 | Wu | |
| 5,967,605 A | | 10/1999 | Stanfield | |
| 6,099,073 A | | 8/2000 | Bruschi | |

FOREIGN PATENT DOCUMENTS

| | | |
|---|---|---|
| FR | 78 37000 | 7/1980 |
| FR | 2445125 | 8/1980 |
| GB | 20 98471 A | 11/1982 |
| IT | 536500 | 12/1955 |

* cited by examiner

*Primary Examiner*—Anthony D. Barfield
(74) *Attorney, Agent, or Firm*—Arent Fox Kintner Plotkin & Kahn

(57) ABSTRACT

An injection molded plastic stackable folding chair having a pair of parallel front legs and a pair of parallel back legs pivotally connected to the front legs. The front legs are separated by top, bottom and intermediate crosspieces, wherein the top crosspiece forms a back rest. The back legs are separated by top and bottom crosspieces. A seat is rotatably connected to the front legs by a rod between the backrest and intermediate crosspiece and slidably connected to the back legs by a pair of dowel pins engaging dowel slots formed within inner side faces of the back legs. The seat includes a plurality of stacking guides and a stacking lip integrally formed therein. The stacking guides extend downward and away from a bottom surface of the seat and the stacking lip extends in a direction relatively orthogonal to a top surface of the seat to form a substantially right angle shape. The extending direction of the stacking lip is substantially opposite the extending direction of the stacking guides. The stacking lip includes a notch that engages the top crosspiece of the back legs when the chair is in the open or in use position and receives a lower back corner of a second seat in the closed or folded position, wherein the first and second chairs are orderly stacked together.

16 Claims, 6 Drawing Sheets

STACKABLE FOLDING CHAIR

BACKGROUND OF THE INVENTION

The invention relates to an improved folding chair. More particularly, the invention relates to a stackable folding chair having stacking guides and a notch that permit multiple chairs to be stacked on top of each other and maintained in an organized manner.

DESCRIPTION OF RELATED ART

It is well known that conventional folding chairs provide readily available seating. Typically, such chairs are used as temporary seating arrangements and are easily folded and stored when not in use. For situations involving large audiences, such as when used in arenas, for weddings, and other such events, the large number of folding chairs are usually stacked on top of each other and stored accordingly. Unfortunately, the conventional folding chair suffers from a drawback of being difficult to stack in an organized manner and tend to slide relative to each other when stacked. An attempt to overcome the sliding problem has been to configure containers or carts that are specifically structured to receive and hold the folded chairs in an orderly manner.

Attempts have also been made to design and manufacture folding chairs that do not require separate containers and/or carts specifically configured to store the folded chairs.

U.S. Pat. No. 5,634,684 to Kojima et al. discloses a typical example of stacked folding chairs wherein a separate brace device is attached to the chair legs so as to engage the brace of a second folded chair in order to stack multiple folded chairs. The Kojima et al. folding chair suffers from the drawback of requiring the brace as an additional component that is attached to chair, which increases the cost of manufacturing each chair and adds a step in stacking the chairs as a result of having to ensure the braces of the stacked chairs engage each other.

U.S. Pat. No. 5,738,408 to Wu discloses a stackable folding chair having protrusions integrally formed on a front side of the front legs and a corresponding number of indentations integrally formed on a back side of the same front legs opposite the protrusions. The indentations are configured to receive the protrusions from a second chair.

Therefore, when the chairs are folded and positioned adjacent to one another, the protrusions on the front side of the front legs of a first chair fit within the corresponding indentations on the back side of the front legs of the next or second chair. The first and second chairs are thus retained in the stacked arrangement. Furthermore, each protrusion has a first geometric shape occupying a first surface area. Each indentation is multi-leveled to have a first region adjacent an outer surface of the back leg having the same general geometric shape of the protrusion, but occupies a larger surface area. A second, inner region of each indentation is positioned inward of the first region and has the same geometric shape as the protrusion. The second region is dimensioned so the protrusion sits flush within the second region.

The indentations are formed to have multi levels so the person stacking the chairs can first locate the protrusion within the first region of the indentation. Because the first region of the indentation is larger than the protrusion, the person stacking the chairs is able to generally position the protrusion of the first chair within the first region of the corresponding indentation on the second chair. After the protrusions of the first chair are positioned within the first regions of the corresponding indentations of the second chair, the person stacking the chairs can position the protrusions within the second region to securely stack the first and second chairs together as the outer edges of the first region act as a boundary.

As such, the Wu folding chair suffers from complicated and costly manufacturing methods in order to machine the legs to have the multi leveled indentations capable of receiving the protrusions therein, thereby raising the cost of each chair. Furthermore, the step of aligning the protrusion first with the first region of the indentation and then the second region of the indentation can become rather cumbersome if a large number of chairs is involved in the stacking process.

Another example of an attempt to provide a stackable folding chair is disclosed in U.S. Pat. No. 6,099,073 to Bruschi. Bruschi discloses a stackable plastic folding chair having front legs with shaped portions that extend outwardly from opposite sides of an intermediate section to form stop abutments for ends of a back leg of an adjacent folding chair. The seat of the chair is connected to the front legs by pivot pins and is connected to the back legs by pivot pins. The pivot pins connecting the seat to the front legs are only rotatable, whereas the pivot pins connecting the seat to the back legs are slidable in grooves formed along a longitudinal axis of the back legs. The seat also has a transverse housing positioned at the rear of the seat.

The transverse housing has a U-shape when seen from a side view and is configured to hook a crosspiece connecting the back legs from below. It is important to note that the transverse housing is not a feature of the Bruschi chair involved in the stacking process.

Rather, each front and back leg has a right-angled profile including a larger wing and a smaller wing, respectively, with each large wing being perpendicular to its respective small wing. In the compacted position, the front and back legs are close to each other so as to substantially define side columns having C-shaped profiles. In the compacted position side columns, the large wings of the front legs are next to the small wings of the back legs. Accordingly, first and second shaped portions are provided at upper and lower end sections, respectively, of the front legs to form stop abutments for the first and second ends of the back legs of a second chair in the compacted position that is to be stacked with the first chair in the compacted position.

Put simply, Bruschi uses the wings formed by the shaped portions of the front and back legs to facilitate stacking of multiple chairs. The shaped portions require additional materials and manufacturing steps, thereby increasing the amount of time needed to produce each chair as well as the cost of such.

U.S. Pat. No. 5,967,605 to Stanfield discloses a folding chair having a stacking device or brace that is sized to be fitted snugly to a cylindrical chair leg. The brace engages the brace of a second chair wherein multiple chairs can be stacked in an orderly manner. The braces require additional materials as they are an additional component that must be added to the standard framework of the chair. The braces therefore require additional manufacturing time and material which result in an increased overall cost of the chair.

SUMMARY OF THE INVENTION

It is an object of this invention to overcome the above-described drawbacks of the related art.

It is also an object of this invention to provide a stackable folding chair having stacking guides and a stacking notch integrated into the structure of the seat of the chair.

It is yet another object of this invention to provide a stackable folding chair having a pair of parallel front legs and a pair of parallel back legs pivotally connected to the front legs. The front legs are separated by top, bottom and intermediate crosspieces, wherein the top crosspiece forms a back rest. The back legs are separated by a top and a bottom crosspiece. A seat is rotatably connected to the front legs by a rod between the backrest and intermediate crosspiece and slidably connected to the back legs by a pair of dowel pins that engage dowel slots formed on the inner side face of each back leg. The seat includes a plurality of stacking guides and a stacking lip integrally formed therein. The stacking guides extend downward and away from a bottom surface of the seat and the stacking lip extends in a direction relatively orthogonal to a top surface of the seat to form a substantially right angle shape. The extending direction of the stacking lip is substantially opposite the extending direction of the stacking guides. The stacking lip includes a notch that engages the top crosspiece of the back legs when the chair is in the open or in use position and receives a lower back corner of a second seat in the closed or folded position, wherein the first and second chairs are orderly stacked together.

These and other objects and aspects of the invention will be described in or be apparent from the following description of the preferred embodiment.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENT

Figure 1:
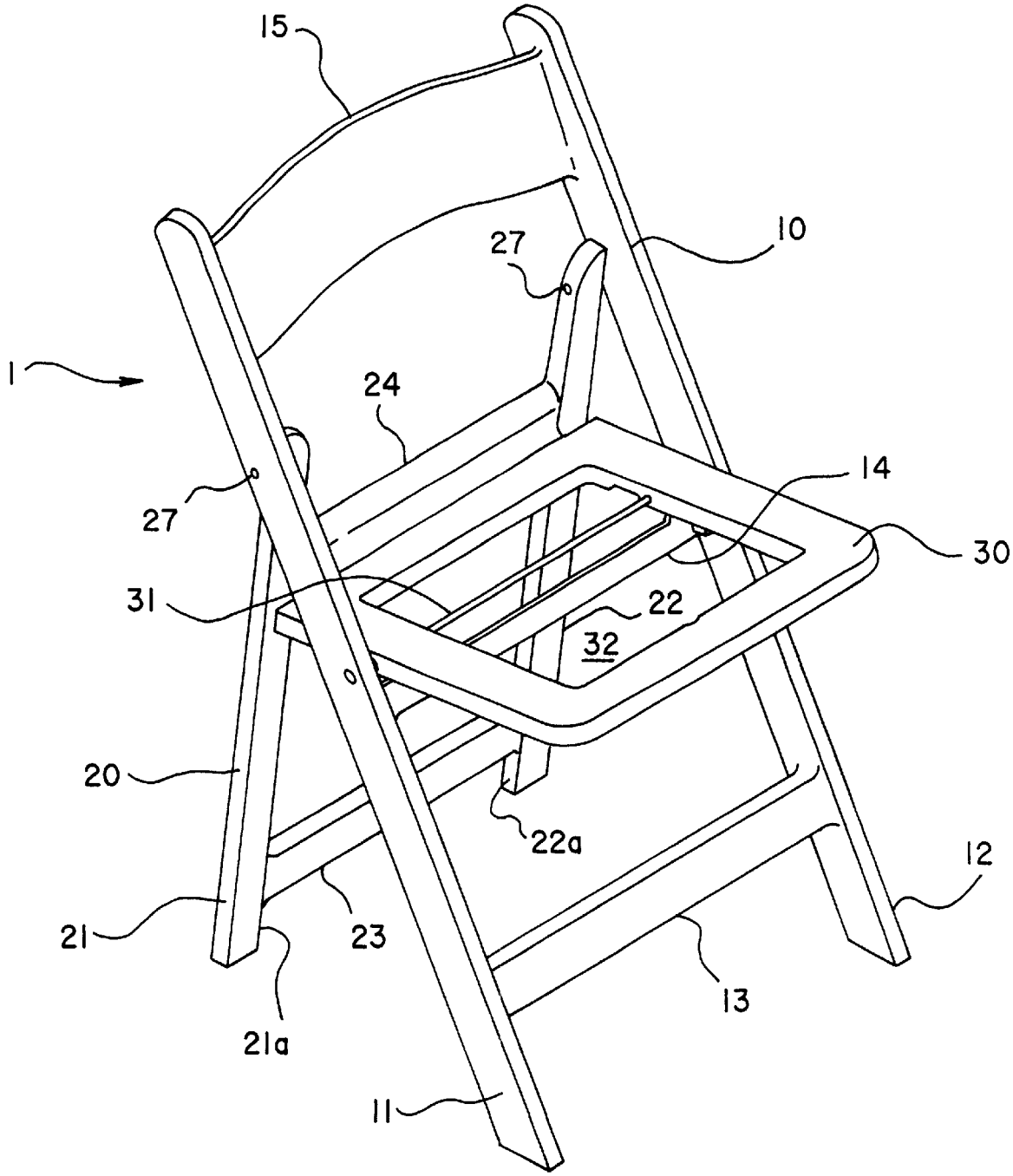
FIG. 1 is a perspective view of the stackable folding chair according to the preferred embodiment of this invention with the chair in the open or in use position.

FIG. 1 is a perspective view of a stackable folding chair 1 according to the preferred embodiment of this invention with the chair in the open or in use position. Preferably, the below-described components of the chair 1 are primarily formed using plastic or resin injection molding techniques. However, it is within the scope of this invention to manufacture the components of the chair 1 from any other suitable material, such, as, for example, metal, wood, and the like.

The chair 1 includes a main frame 10 having a pair of substantially parallel front legs 11 and 12 separated by a bottom crosspiece 13, an intermediate crosspiece 14, and a top crosspiece 15, wherein the top crosspiece 15 forms a backrest. A support frame 20 has a pair of substantially parallel back legs 21 and 22 pivotally connected to the front legs 11 and 12 by pivot pins 27, 27. The back legs 21 and 22 are separated by a bottom crosspiece and a top crosspiece, 23 and 24, respectively.

A seat 30 has a substantially rectangular shape body and is pivotally connected to the front legs 11 and 12 by a rod 31 at a location above the intermediate crosspiece 14 and below the pivot pins 27, 27 connecting the support frame 20 to the main frame 10. It should be noted that it is within the scope of this invention to have the rod 31 formed either from plastic or resin injection molding techniques, metal, wood or any other suitable material. Furthermore, the seat 30 is connected to the back legs 21 and 22 by dowel pins 38 (FIG. 2) positioned within dowel slots 29 (FIG. 3) formed within the inner side faces 21 a and 22*a* of the back legs 21 and 22, respectively, at a location below the upper crosspiece 24 of the support frame 20. The dowel pins 38 are slidable in the substantially linear dowel slots 29 formed in the back legs 21 and 22.

It should be noted that the seat 30 shown in the drawing figures has an opening 32 defined therein merely for explanatory purposes as well as to better illustrate the spatial and working relationship of the features of the chair 1. It is within the scope of this invention to have a seat 30 with a solid body, i.e., no opening, or even a covering element (not shown) that covers or fills the opening 32.

Figure 2:
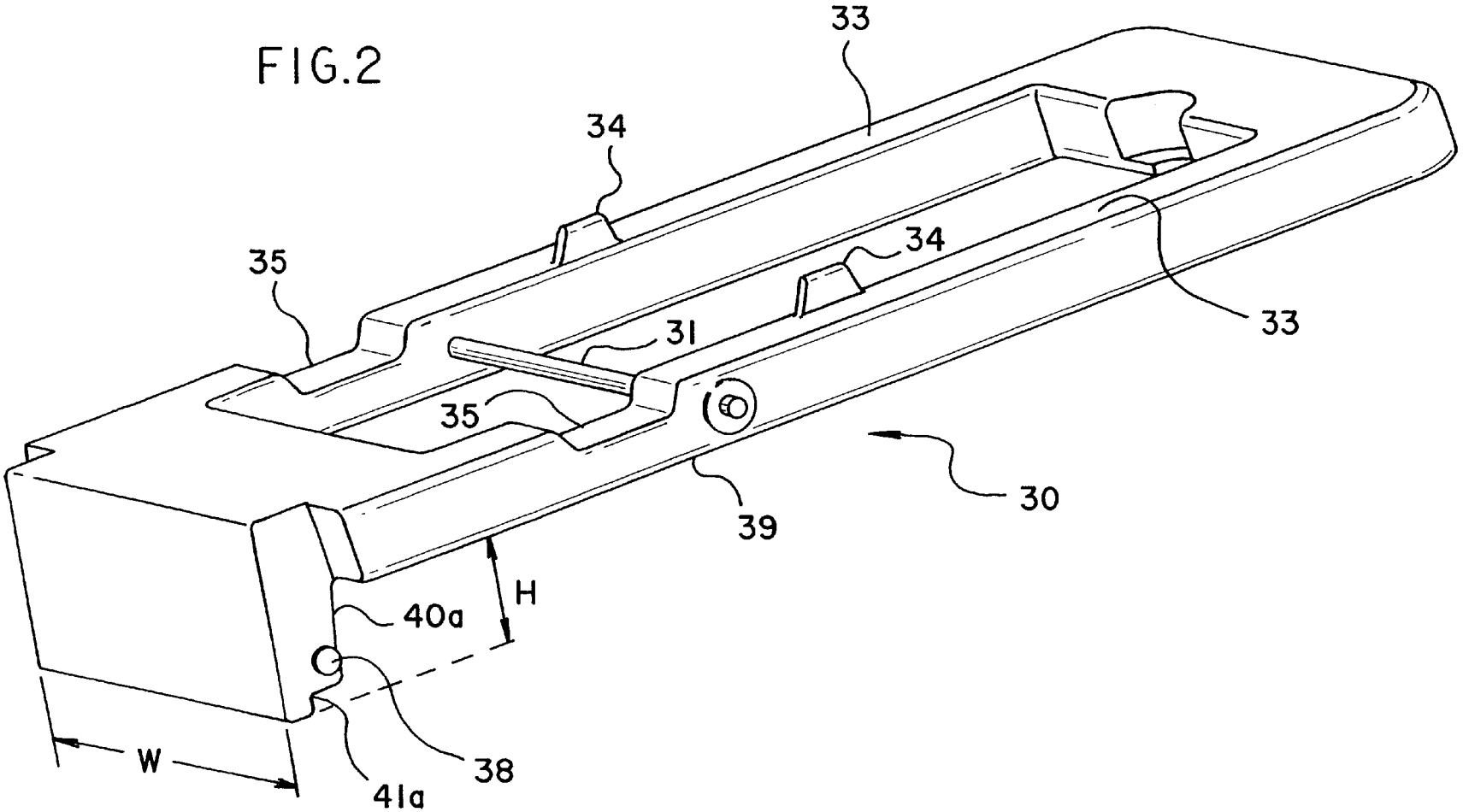
FIG. 2 is a perspective view of the seat of the stackable folding chair according to this invention.
Figure 3:
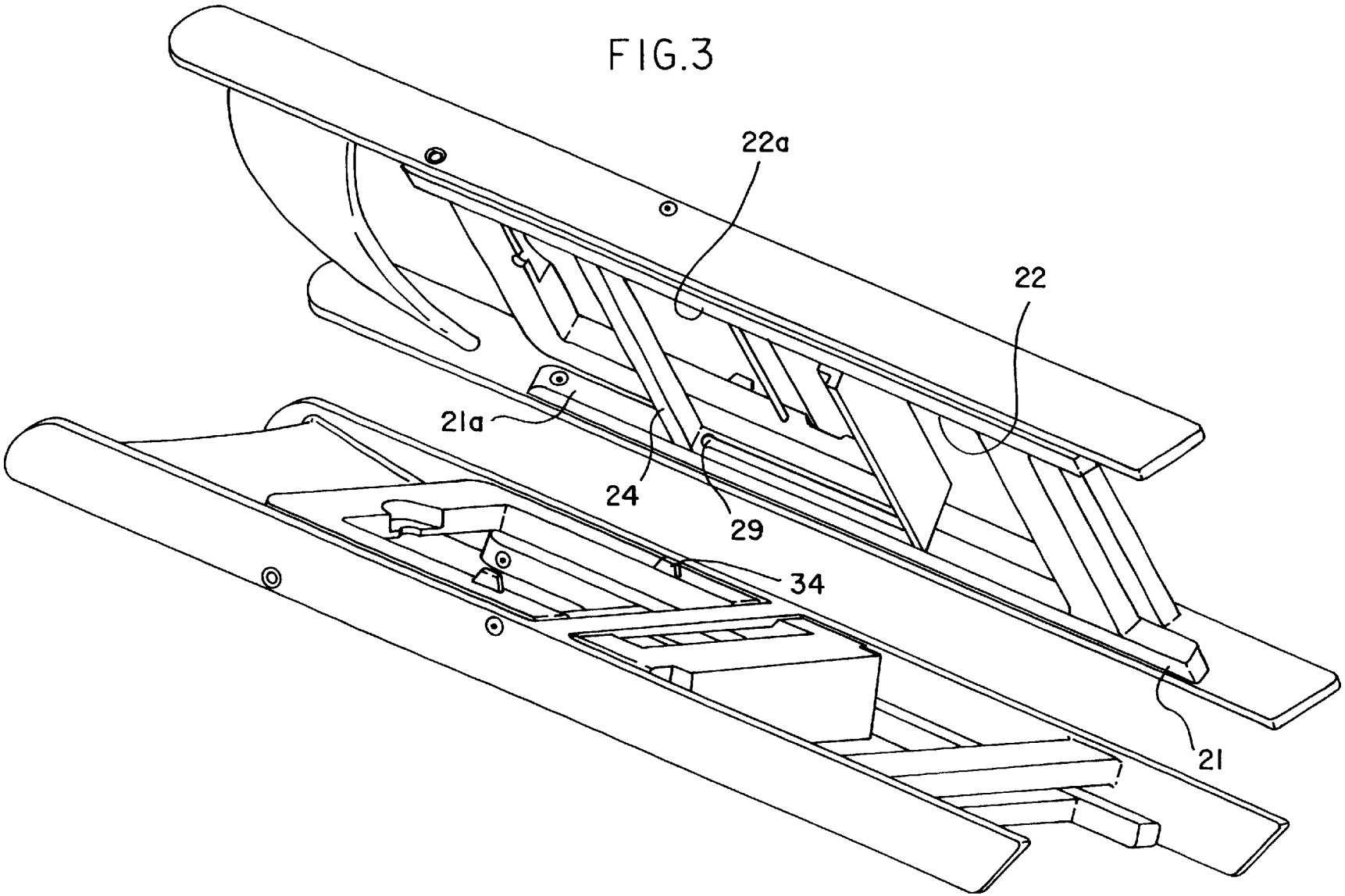
FIG. 3 is a perspective view of two stackable folding chairs before being stacked together.
Figure 4:
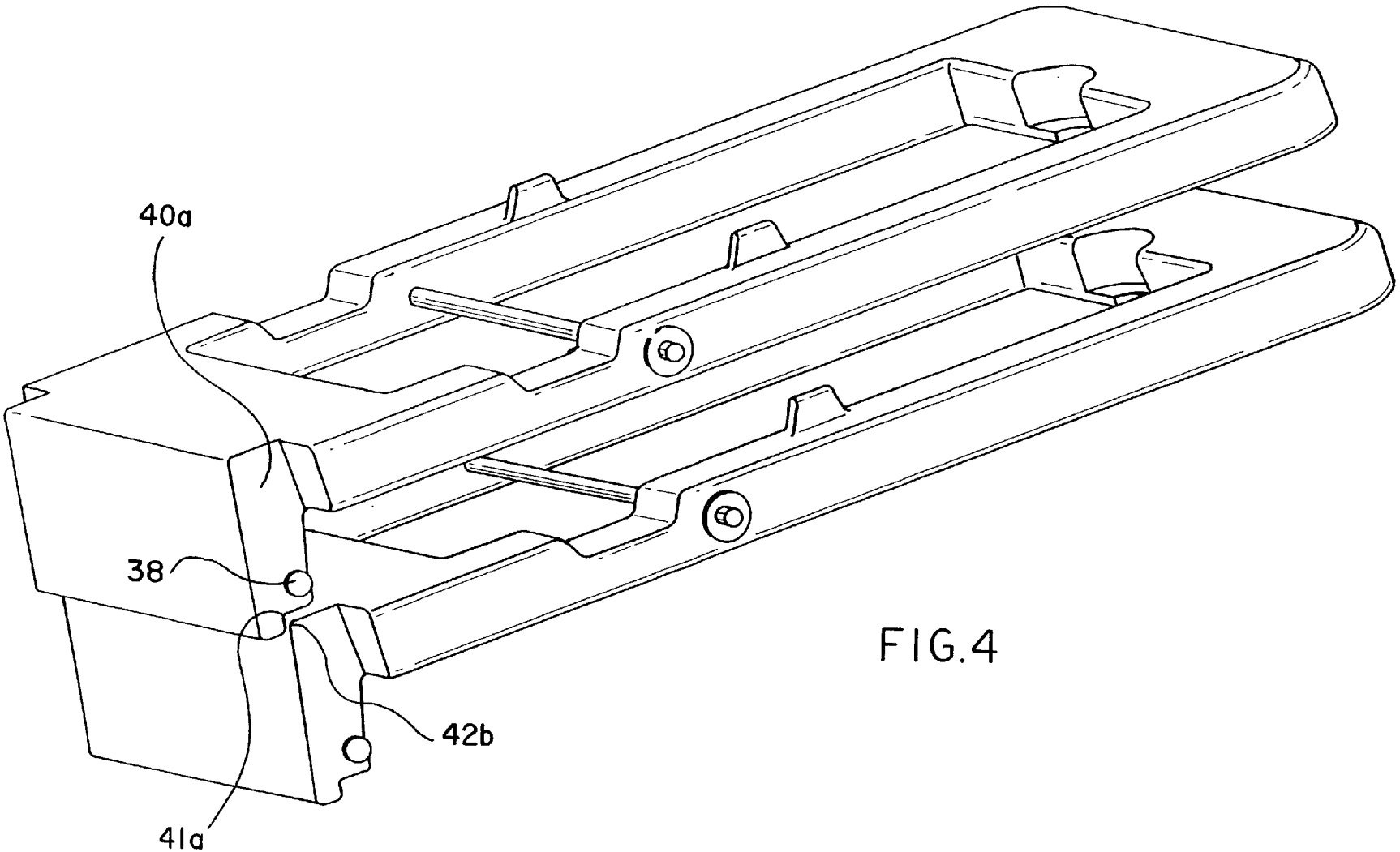
FIG. 4 is a perspective view of two seats stacked together.

As shown in FIG. 2, a bottom surface 33 of the seat 30 includes a pair of stacking guides 34 extending away therefrom and a receiving groove 35 that receives the intermediate crosspiece 14 of the main frame 10 when the chair 1 is folded. A stacking lip 40*a* is integrally formed with the seat 30 and extends away from an upper surface 39 of the seat in an orthogonal direction relative thereto to form a substantially right angle shape. The extending direction of the stacking lip 40*a* is substantially opposite relative to the extending direction of the stacking guides 34, i.e., upward and away from the upper surface 39 of the seat 30. The stacking lip 40*a* includes a notch 41*a* extending substantially across an entire width W of the seat 30. The notch 41*a* that engages the top crosspiece 24 of the support frame 20 when the chair 1 is in the open or in use position. Furthermore, the stacking lip 40*a* has vertical height H relative to the upper surface 39 of the seat 30. The vertical height H of the stacking lip 40*a* is of a length wherein the notch 41*a* of the stacking lip 40*a* extends beyond an outer boundary defined by a rear face of either the front and back legs, 11, 12 and 21, 22, respectively, when the chair is in the folded position. As shown within the circle of FIG. 4, the notch 41*a* receives a lower rear corner 42*b* of a second seat when the first and second seats are in the closed or folded position (FIG. 5), thereby permitting the first and second chairs to be orderly stacked together.

Figure 5:
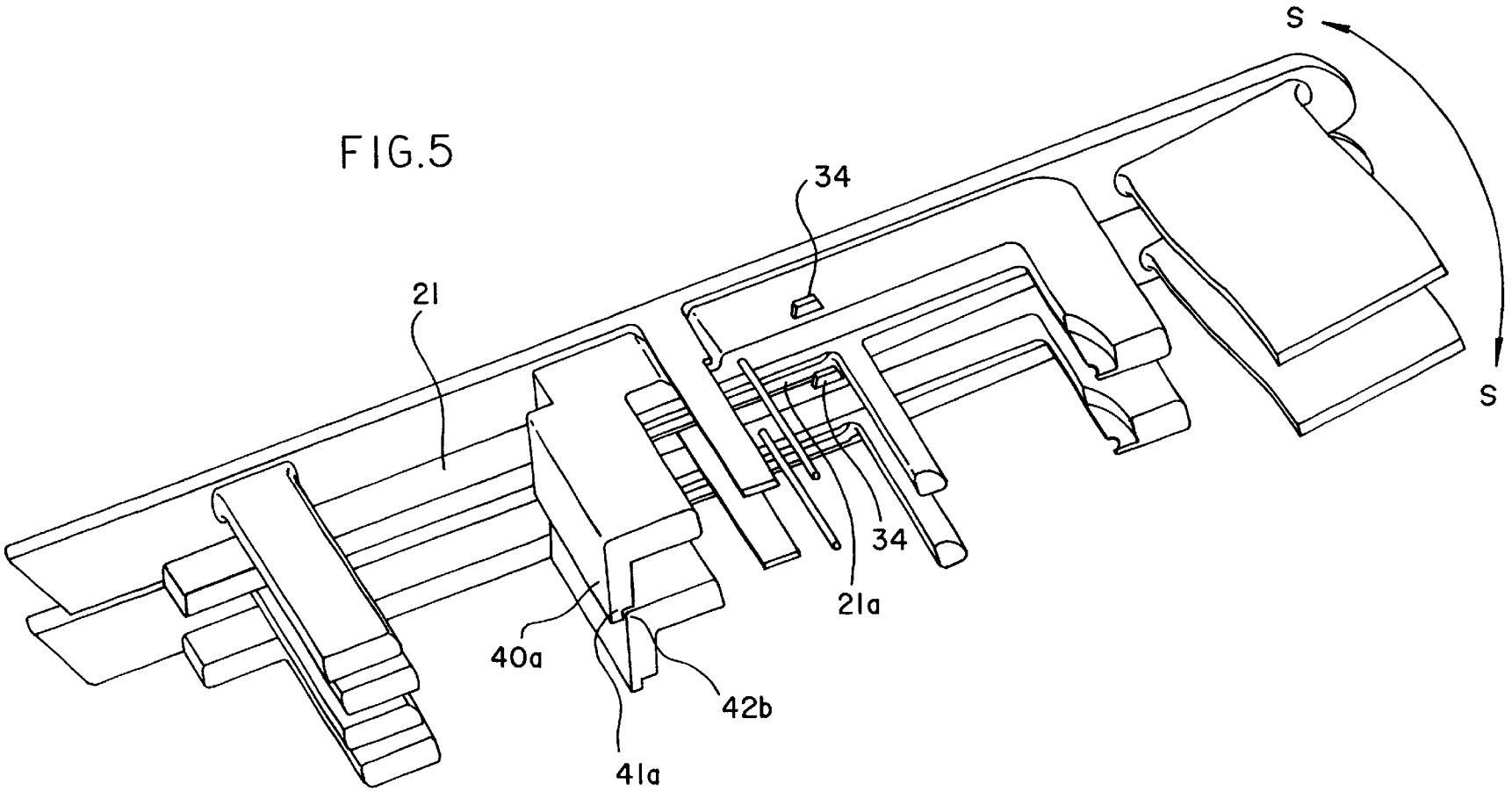
FIG. 5 is a sectional view of two stacked chairs.

As shown in FIG. 5, when multiple chairs are folded to be stacked on top of each other, the stacking guides 34 of the first chair extend toward the second chair. The stacking guides 34 of each chair are designed to prevent the stacked chairs from sliding side to side as indicated by the line S-S when the chairs are stacked vertically, i.e., the support frame and seat of each chair are folded up or closed. Furthermore, the notch 41*a* prevents the stacked chairs from sliding forward and backward relative to each other.

The stacking guides 34 also provide an important function when the chair 1 is in the open or in use position. In particular, the stacking guides 34 extending downward and away from the bottom surface 33 of the seat 30 engage the intermediate crosspiece 14 separating the front legs 11 and 12 of the main frame 10 (FIG. 1). This arrangement of the stacking guides 34 in conjunction with the notch 41*a* of the stacking lip 40*a* engaging the top crosspiece 24 of the support frame 20 prevent the seat 30 from sliding on top of the crosspiece 14. Therefore, when a downward force is applied to the seat 30, such as, for example, when a person sits down on the seat when the chair is in the open or in use position, the stacking guides 34 engaging the intermediate crosspiece 14 and the notch 41*a* engaging the top crosspiece 24 prevent the back legs 21 and 22 from separating away from the front legs 11 and 12.

The chair 1 is used as follows.

Figure 6:
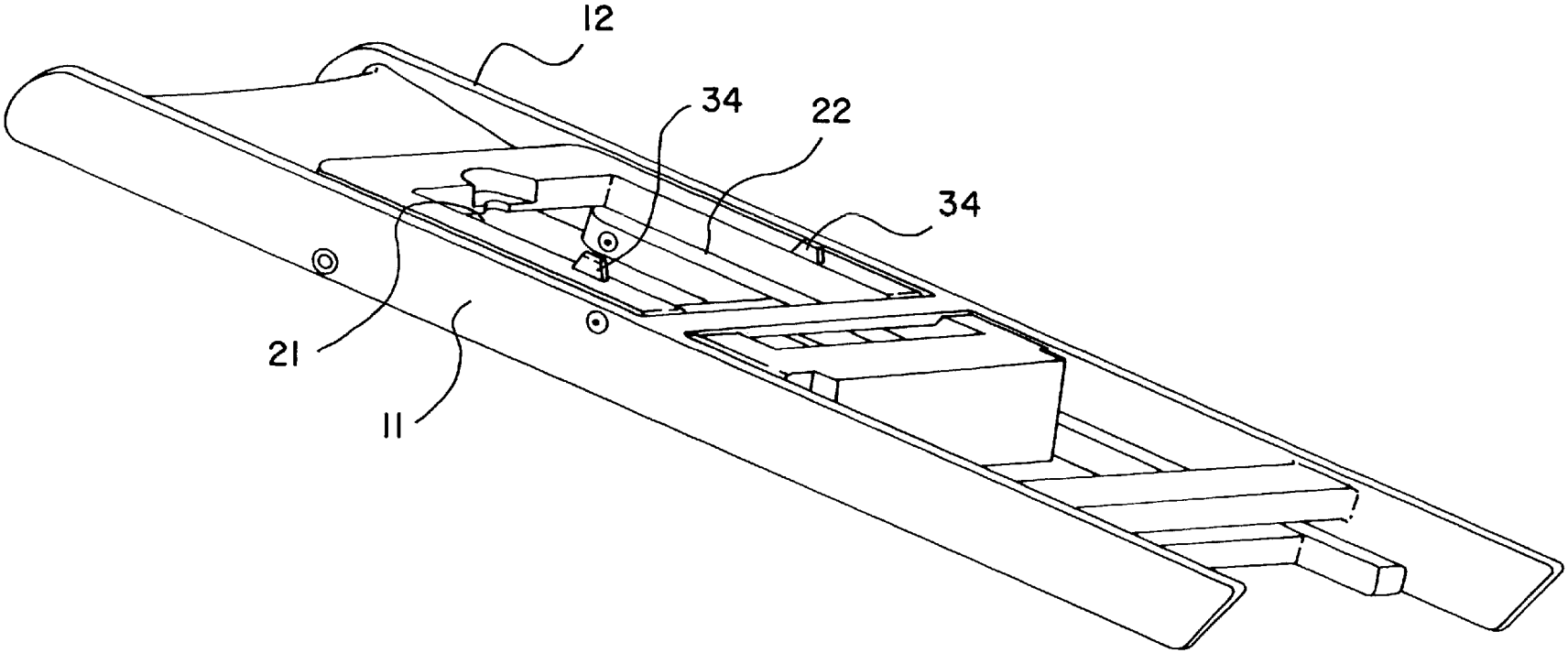
FIG. 6 is a perspective view of a folded chair.

When the chair 1 is in the dosed or folded position as shown in FIG. 6, the chair 1 is ready to be stacked onto other such chairs. Furthermore, the support frame 20 of the chair 1 rotates toward the main frame 10 wherein outer side surfaces of the back legs 21 and 22 of the support frame 20 abut inner side surface of the front legs 11 and 12 of the main frame 10. Additionally, a front portion of the seat 30 is proximate the backrest 15 of the main support 10 while the rear portion of the seat having the stacking lip 40*a* is located between the intermediate crosspiece 14 and the lower crosspiece 13 of the main support 10. The receiving groove 35 of the seat 30 is configured to engage the intermediate crosspiece 14 of the main support 10.

Therefore, when viewed from the side of the folded chair 1, the notch 41*a* of the stacking lip 40*a* extends beyond an outer boundary defined by a rear face of either the front and back legs, 11, 12 and 21, 22, respectively. As such, the notch 41*a* is able to receive a lower rear corner 42*b* of a second seat when the first and second seats are in the closed or folded position (FIG. 5), thereby permitting the first and second chairs to be orderly stacked together. Furthermore, the stacking guides 34 of each chair prevent the stacked chairs from sliding side to side relative to each other.

Accordingly, an orderly and manageable stacking of multiple folding chairs is obtained.

To place the folded chair 1 in the open or in use position, the front portion of the seat 30 is rotated around rod 31 outwardly in a direction away from the abutting front and back legs 11, 12 and 21, 22, respectively. Simultaneously, the dowel pins 38 slide along the substantially linear dowel slots 29 formed in the rear legs 21, and 22 in an upward direction relative to the backrest 15. The sliding motion of the dowel pins 38 within the dowel slots 29 forces the rear legs 21, 22 of the support frame 20 to rotate around pins 27 and away from the front legs 11, 12 of the main frame 10. At the moment the dowel pins 38 reach the top of the dowel slots 29, the notch 41*a* of the stacking lip 40*a* engages the top crosspiece 24 of the support frame 20.

While the invention has been described in conjunction with the preferred embodiment thereof, it is evident that many alternatives, modifications and variations may be apparent to those skilled in the art. For example, the stacking guides may be configured to have any suitable geometric configuration, such as, for example, circular, rectangular, trapezoidal, triangular, rhomboidal, oval, square, pentagonal, octagonal, parabolic, hyperbolic, elliptical, conical, and the like. Accordingly, the specific embodiment of the invention as set forth herein is intended merely to be illustrative, not limiting. Various changes may be made without departing from the spirit and scope of the invention as set forth in the following claims.

What is claimed is:

1. A seat usable with a stackable folding chair having a main frame including a pair of substantially parallel front legs separated by lower, intermediate, and upper crosspieces, the top crosspiece forming a backrest, each of the front legs having an inner side face and a rear face, a support frame including a pair of substantially parallel back legs separated by upper and lower crosspieces, each of the back legs having inner and outer side faces along with a rear face and being pivotally connected to the front legs by pivot pins, the inner side faces of each of the back legs having a dowel slot, the seat comprising:

a body, wherein the body has an upper surface;

a rod pivotally connecting the seat to the main frame; and a stacking lip that extends away from the upper surface of the seat body in an orthogonal direction relative thereto to form a substantially right angle shape, the stacking lip including a notch extending substantially across an entire width of the seat body, the stacking lip having a vertical height wherein the notch extends beyond an outer boundary defined by the rear face of either one of the front and back legs when the chair is in a folded position.

2. The seat according to claim 1, further comprising a pair of dowel pins that slidingly engage the dowel slots of the inner side faces of the back legs.

3. The seat according to claim 1, wherein the notch is configured to receive a lower back portion of a seat of another folding chair and wherein the notch permits stacking of a plurality of chairs.

4. The seat according to claim 1, wherein the notch engages the upper crosspiece of the support frame when the chair is in an open position.

5. The seat according to claim 1, Wherein the seat body further comprises:

a lower surface opposite the upper surface; and a pair of stacking guides extending away from the lower surface of the seat, wherein the stacking guides engage the inner side faces of the back legs when the chair is in the folded position to prevent the chair from sliding off another chair upon which the chair is stacked.

6. The seat according to claim 5, wherein the stacking guides engage the intermediate crosspiece of the main frame when the chair is in an open position to prevent the seat from sliding relative to the main frame while the chair is in use.

7. The seat according to claim 5, further comprising a pair of receiving grooves positioned on the lower surface of the seat, the receiving grooves engage the intermediate crosspiece of the main frame when the seat is in the folded position.

8. The seat according to claim 1, wherein the seat is formed of an injection molded plastic.

9. A stackable folding chair, comprising:

a main frame including a pair of substantially parallel front legs separated by lower, intermediate, and upper crosspieces, wherein the top crosspiece forms a backrest, each of the front legs having an inner side face and a rear face;

a support frame including a pair of substantially parallel back legs separated by upper and lower crosspieces, wherein each back leg has inner and outer side faces along with a rear face and is pivotally connected to the front legs by pivot pins, the inner side faces of each of the back legs having a dowel slot; and a seat connected to the main frame, the seat comprising:

a rod pivotally connecting the seat to the main frame;

an upper surface; and a stacking lip that extends away from the upper surface of the seat in an orthogonal direction relative thereto to form a substantially right angle shape, the stacking lip including a notch extending substantially across an entire width of the seat, the stacking lip having a vertical height wherein the notch extends beyond an outer boundary defined by of the rear face of either the front and back legs when the chair is in a folded position.

10. The folding chair according to claim 9, wherein the seat further comprises a pair of dowel pins that slidingly engage the dowel slots of the inner side faces of the back legs.

11. The folding chair according to claim 9, wherein the notch is configured to receive a lower back portion of a seat of another folding chair and wherein the notch permits stacking of a plurality of chairs.

12. The folding chair according to claim 9, wherein the notch engages the upper crosspiece of the support frame when the chair is in an open position.

13. The folding chair according to claim 9, wherein the seat further comprises:

a lower surface; and a pair of stacking guides extending away from the lower surface of the seat, wherein the stacking guides engage the inner side faces of the back legs when the chair is in the folded position to prevent the chair from sliding off another chair upon which the chair is stacked, and wherein the notch of the stacking lip prevents the chair in the folded position from sliding forward and backward relative to the other chair upon which the chair is stacked.

14. The folding chair according to claim 13, wherein the stacking guides engage the intermediate crosspiece of the main frame when the chair is in an open position to prevent the seat from sliding relative to the main frame while the chair is in use.

15. The folding chair according to claim 13, wherein the seat further comprises a pair of receiving grooves positioned on the lower surface of the seat, the receiving grooves engage the intermediate crosspiece of the main frame when the seat is in the folded position.

16. The folding chair according to claim 9, wherein the chair is formed of an injection molded plastic.

* * * * *

UNITED STATES PATENT AND TRADEMARK OFFICE

CERTIFICATE OF CORRECTION

PATENT NO. : 6,592,182 B1
DATED : December 10, 2002
INVENTOR(S) : Bright et al.

It is certified that error appears in the above-identified patent and that said Letters Patent is hereby corrected as shown below:

Title page,
Item [*] Notice, delete "by 34 days" and insert -- by 0 days --.

Signed and Sealed this

Second Day of May, 2006

JON W. DUDAS
*Director of the United States Patent and Trademark Office*

UNITED STATES PATENT AND TRADEMARK OFFICE

CERTIFICATE OF CORRECTION

PATENT NO. : 6,592,182 B1
APPLICATION NO. : 10/102664
DATED : July 15, 2003
INVENTOR(S) : Bright et al.

It is certified that error appears in the above-identified patent and that said Letters Patent is hereby corrected as shown below:

Title page,
Item [*] Notice, delete "by 34 days" and insert -- by 0 days --.

This certificate supersedes Certificate of Correction issued May 2, 2006.

Signed and Sealed this

Eighth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,592,182 B1
APPLICATION NO. : 10/102664
DATED : July 15, 2003
INVENTOR(S) : Zunaidi Bin Noor It is certified that error appears in the above-identified patent and that said Letters Patent is hereby corrected as shown below:

This certificate supersedes Certificates of Correction issued May 2, 2006 and August 8, 2006. The Certificates of Corrections is to be vacated since no Certificate of Correction was granted for this patent number.

Signed and Sealed this

Twenty-seventh Day of March, 2007

JON W. DUDAS
*Director of the United States Patent and Trademark Office*